US009071915B2

(12) United States Patent
Roeck et al.

(10) Patent No.: US 9,071,915 B2
(45) Date of Patent: Jun. 30, 2015

(54) METHOD FOR TESTING A HEARING DEVICE AS WELL AS AN ARRANGEMENT FOR TESTING A HEARING DEVICE

(75) Inventors: Hans-Ueli Roeck, Hombrechtikon (CH); Rainer Platz, Colombier (CH); Michael Boretzki, Rüti (CH); Stefan Launer, Zürich (CH); Nicola Schmitt, Stäfa (CH)

(73) Assignee: PHONAK AG, Stafa (CH)

( * ) Notice: Subject to any disclaimer, the term of this patent is extended or adjusted under 35 U.S.C. 154(b) by 204 days.

(21) Appl. No.: 13/821,634

(22) PCT Filed: Oct. 22, 2010

(86) PCT No.: PCT/EP2010/065981

§ 371 (c)(1),
(2), (4) Date: Mar. 8, 2013

(87) PCT Pub. No.: WO2011/029959

PCT Pub. Date: Mar. 17, 2011

(65) Prior Publication Data

US 2013/0243210 A1 Sep. 19, 2013

(51) Int. Cl.
*H04R 25/00* (2006.01)

(52) U.S. Cl.
CPC ..... *H04R 25/30* (2013.01); *H04R 25/70* (2013.01); *H04R 2225/55* (2013.01)

(58) Field of Classification Search
CPC ..... H04R 25/30; H04R 25/305
USPC ..... 381/60, 312, 314, 315
See application file for complete search history.

(56) References Cited

U.S. PATENT DOCUMENTS

| | | | |
|---|---|---|---|
| 6,671,643 | B2 | 12/2003 | Kachler et al. |
| 6,792,114 | B1 | 9/2004 | Kates et al. |

(Continued)

FOREIGN PATENT DOCUMENTS

| | | | |
|---|---|---|---|
| CN | 2774066 | Y | 4/2006 |
| DE | 10354897 | A1 | 6/2005 |
| EP | 1276349 | A1 | 1/2003 |
| EP | 1865746 | A2 | 12/2007 |

OTHER PUBLICATIONS

International Search Report for PCT/EP2010/065981 dated Jun. 27, 2011.
Written Opinion for PCT/EP2010/065981 dated Jun. 27, 2011.

*Primary Examiner* — Rasha Al Aubaidi
(74) *Attorney, Agent, or Firm* — Pearne & Gordon LLP

(57) ABSTRACT

A method for testing a hearing device (1, 4) comprising at least one microphone unit (2) and a receiver unit (3) is disclosed. The method comprising the steps of positioning the hearing device (1) at a predefined position in relation to an accessory device (4) comprising a microphone (5) and a loudspeaker (6), generating a first sound signal (7) by the loudspeaker (6), recording the first sound signal (7) by the microphone unit (2), generating a second sound signal (8) by the receiver unit (3), the second sound signal (8) being at least partly dependent on the recorded first sound signal (7), recording the second sound signal (8) by the microphone (5), evaluating the recorded second sound signal (8), and at least triggering further action based on results of evaluating the recorded second sound signal (8) in case the results do not conform to predefined expectation. Furthermore, an arrangement for testing a hearing device (1, 4) is also disclosed.

13 Claims, 2 Drawing Sheets

(56) References Cited

U.S. PATENT DOCUMENTS

| | | | | |
|---|---|---|---|---|
| 7,747,026 | B2 * | 6/2010 | Ball | 381/60 |
| 2008/0253579 | A1 | 10/2008 | Cronin et al. | |
| 2010/0246841 | A1 * | 9/2010 | Ball | 381/60 |
| 2011/0228948 | A1 * | 9/2011 | Engel | 381/74 |
| 2012/0140963 | A1 * | 6/2012 | Larsen et al. | 381/315 |

* cited by examiner

METHOD FOR TESTING A HEARING DEVICE AS WELL AS AN ARRANGEMENT FOR TESTING A HEARING DEVICE

FIELD OF THE INVENTION

The present invention is related to a method for testing a hearing device as well as to an arrangement for testing the hearing device.

BACKGROUND OF THE INVENTION

A hearing device is used to improve the hearing of a hearing impaired person in that surrounding sound is picked-up by a microphone. The sound signal is processed taking into account the hearing impairment in order to obtain a processed sound signal that allows the hearing device user to have an improved hearing. In particular hearing device components exposed to the surrounding are subject to wear. Such components are, for example, microphone protections, microphones themselves, receivers and tubing systems. Due to the exposure to the surrounding, these components may become dirty or even stop working due to the dirt or due to mechanical stress, for example, from falling to the floor. Thus, hearing devices must be tested regularly in order to function reliably.

Classically, the functioning of a hearing device is checked by holding it in a closed hand. If it starts whistling, everything is assumed to work correctly. This is a rather crude self test though, and does not allow identifying any specific problem.

Self tests have already been proposed to check some of the components of a hearing device. Most of these known teachings use a box with a defined acoustic path between receiver and microphone of the hearing device. Reference is made to the teachings described in EP-1 865 746 A2, DE-103 54 897 A1, U.S. Pat. No. 6,671,643 B2, and US-2008/0 253 579 A1. The box may be the one, in which the hearing device has been bought, or, a box that has to be purchased by the hearing device user as an accessory. In any case, the box must be available to perform the test, which is perceived as disadvantage by the hearing device user because the box is very often not available or cannot be found when needed. Furthermore, the manufacturer of the hearing device must have a stock of boxes to be able to provide replacement boxes for the hearing device user. As a result thereof, the production costs for such hearing devices increase.

Another known teaching discloses a hearing device with an internal signal generator that allows generating a test sound signal which is picked up by the microphone and tested internally. In this connection, reference is made to U.S. Pat. No. 6,792,114 B1 and to EP-1 276 349 B1. The known teachings have both the disadvantage that the acoustic path is not well defined between receiver and microphone, thus an attenuation that is due to a dirty microphone protection, for example, is not reliably detectable.

Furthermore, all methods, which use an internal signal generator to measure the signal path towards the microphone of the hearing device lack of the problem that they cannot easily distinguish, if an attenuation is caused by a dirty microphone protection or a dirty receiver/wax guard, or if one or the other is broken as both lie in the same signal path. This is even the case when the acoustic signal path between the receiver and the microphone of the hearing device is completely incorporated into a box.

It is therefore an object of the present invention to provide an easy and cheap method for testing a hearing device that does at least not have some of the disadvantages of the prior art.

SUMMARY OF THE INVENTION

The present invention is directed to a method for testing a hearing device comprising at least one microphone unit and a receiver unit, the method comprising the steps of:

- positioning the hearing device at a predefined position in relation to an accessory device comprising a microphone and a loudspeaker,
- generating a first sound signal by the loudspeaker,
- recording the first sound signal by the microphone unit,
- generating a second sound signal by the receiver unit, the second sound signal being at least partly dependent on the recorded first sound signal,
- recording the second sound signal by the microphone,
- evaluating the recorded second sound signal, and
- at least triggering further action based on results of evaluating the recorded second sound signal in case the results do not conform to predefined expectation.

As the accessory device may also be a further hearing device, the loudspeaker may also be a receiver unit.

An embodiment of the present invention further comprises the step of indicating the predefined position on a display unit comprised in the accessory device. This allows an exact, reproduce-able positioning of the hearing device in relation to the accessory device resulting in compare-able tests.

It would be an additional advantage, if the result of the self test are made available to the manufacturer and/or the fitter for supporting the user better and gaining statistical results usable to improve the behavior of the hearing device even further.

In further embodiments of the present invention, the accessory device is one of the following devices:

- a mobile phone;
- a personal digital assistant device;
- a second hearing device;
- a remote control unit.

Further embodiments of the present invention comprise the step of initiating the testing of the hearing device by at least one of the following manners:

- activating a switch unit at the hearing device;
- activating a remote control unit that is operatively connected to the hearing device;
- activating the accessory device.

Further embodiments of the present invention comprise the step of limiting a maximum gain of the hearing device applied to the first sound signal in order to prevent feedback.

In further embodiments of the present invention, the second sound signal comprises information that is not correlated to the first sound signal.

In further embodiments of the present invention, the information not being correlated to the first sound signal is predefined, and wherein the information is used to evaluate an acoustic path between the receiver unit and the microphone unit.

Further embodiments of the present invention comprise the step of setting up a connection to a remote provider unit, the remote provider unit or an application running on the accessory device being able to guide through a testing sequence.

Furthermore, the present invention is also directed to an arrangement for testing a hearing device, the arrangement comprising:

- an accessory device comprising a microphone and a loudspeaker for generating a first sound signal,
- a hearing device comprising a microphone unit and a receiver unit for generating a second sound signal, wherein the loudspeaker is acoustically coupled to the microphone unit, and the receiver unit is acoustically coupled to the microphone, means for evaluating the second sound signal recorded by the microphone, and means for at least triggering further action based on results of evaluating the second sound signal recorded by the microphone in case the results do not conform to predefined expectation.

In an embodiment of the present invention, the accessory device comprises a display unit for indicating a predefined position for the hearing device.

In further embodiments of the present invention, the accessory device is at least one of the following devices:

a mobile phone;

a personal digital assistant device;

a second hearing device;

a remote control unit.

Still further embodiments of the present invention comprise means for activating a testing sequence, said means being comprised on at least one of the following components:

the hearing device;

a remote control unit that is operatively connected to the hearing device;

the accessory device or the second hearing device, respectively.

In still further embodiments of the present invention, the second sound signal comprises information that is not correlated to the first sound signal.

In still further embodiments of the present invention, the information not being correlated to the first sound signal is predefined, and wherein the information is used to evaluate an acoustic path between the receiver unit and the microphone unit.

Further embodiments of the present invention comprise a remote provider unit that is operatively connectable to at least one of the accessory device and the hearing device.

It is pointed out that any combination of the above-mentioned embodiments is possible. Only those embodiments are excluded that would otherwise result in a contradiction.

BRIEF DESCRIPTION OF THE DRAWINGS

The present invention is further described by referring to drawings showing exemplified embodiments of the present invention.

DETAILED DESCRIPTION OF THE INVENTION

Figure 1:
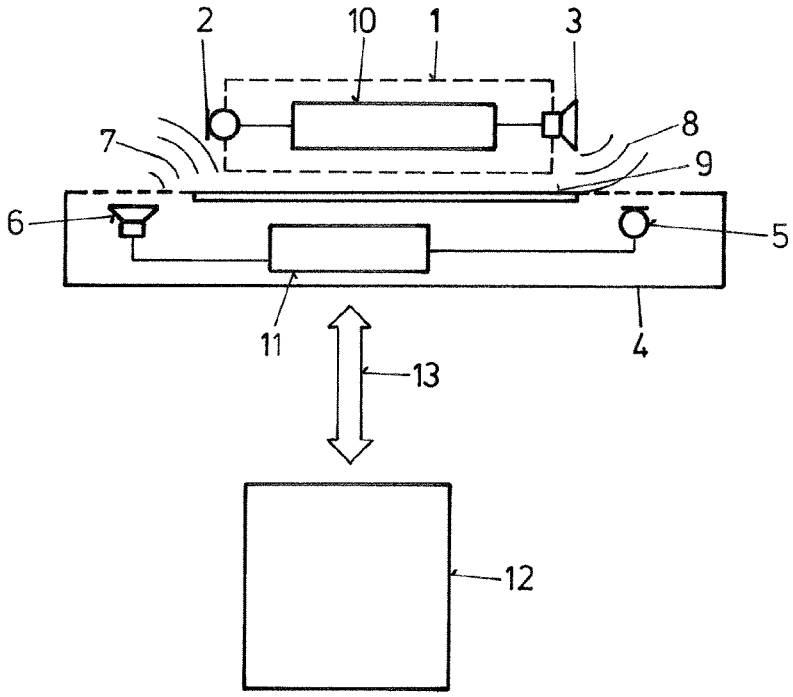
FIG. 1 shows an arrangement according to one embodiment of the present invention with a hearing device to be tested and an accessory device.

In FIG. 1, an arrangement for testing a hearing device 1 is depicted, the arrangement comprising the hearing device 1, an accessory device 4 and a remote control unit 12.

The hearing device 1 comprises a signal processing unit 10 that is operatively connected to a microphone unit 2 to pick up input sound as well as to a receiver unit 3 to generate output sound. As it is well known in the art, the signal processing unit 10 processes the picked-up input sound in order to compensate the hearing impairment of the hearing device user. The processed sound is then fed to the receiver unit 3 in which the output sound is generated.

For testing the hearing device 1 or its components, in particular the microphone unit 2 and the receiver unit 3, the hearing device 1 is arranged in relation to the accessory unit 4 comprising a microphone 5 and a loudspeaker 6. The positioning of the hearing device 1 in relation to the accessory device 4 must be in a manner that a good acoustic coupling is reached between the receiver unit 3 of the hearing device 1 and the microphone 5 of the accessory device 4 as well as between the loudspeaker 6 of the accessory device 4 and the microphone unit 2 of the hearing device 1. In one embodiment, the positioning is predefined in order to reproduce the same coupling condition between the corresponding components for every testing procedure. Thereto, the accessory device 4 may comprise a display unit 9, for example, for indicating the exact position, at which the hearing device must be placed in order to obtain the same acoustic coupling whenever there is a need to run the test procedure yet to be described.

The accessory device 4 further comprises a calculation unit 11 that is operationally connected to the microphone 5 as well as to the loudspeaker 6. The calculation unit 11 may process the sound picked-up by the microphone before an output sound is generated by the loudspeaker 6. Possible processing schemes will be described in connection with FIG. 4. Furthermore, the calculation unit 11 is also operatively connected to the display unit 9 to control it.

In the following, a method for testing the hearing device 1 is described as it is proposed by one embodiment of the present invention:

As already pointed out, the positioning of the hearing device 1 in relation of the accessory device 4 is important to obtain a reproducible acoustic coupling of the corresponding components, i.e. the loudspeaker 6 with the microphone unit 2 and the receiver unit 3 with the microphone 5. Thereto, a predefined position is displayed on the display unit 9 of the accessory device 4, for example, in order that the hearing device user may easily find the predefined position. In another embodiment, the hearing device 1 may be forced into a predefined position mechanically, as for example by attaching the hearing device 1 to a hook-like element of the accessory device 4, wherein the hook-like element has a particular shape adapted to the hearing device 1 to be tested.

Once the predefined position of the hearing device 1 in relation to the accessory device 4 is reached, a first sound signal 7 is generated in the loudspeaker 6 via the calculation unit 11. The first sound signal 7 is recorded by the microphone unit 2 of the hearing device 1. Furthermore, a second sound signal 8 is generated by the receiver unit 3, the second sound signal 8 being at least partly dependent on the recorded first sound signal 7. How the first and the second sound signal 7 and 8 are interrelated will also be described in connection with FIG. 4.

The second sound signal 8 is recorded by the microphone 5 of the accessory device 4, in which the recorded second sound signal 8 is evaluated. Based on a result of the evaluation, at least a further action is triggered, in particular in case the result of the evaluation does not conform to a predefined expectation.

In further embodiments of the present invention, the accessory device 4 may be one of the following:

a mobile phone;

a personal digital assistant device;

a second hearing device;

a remote control unit.

Figure 2:
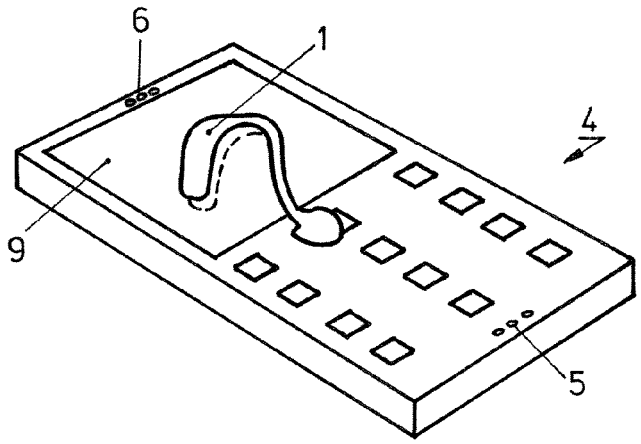
FIG. 2 shows an arrangement according to another embodiment of the present invention, the accessory device being a mobile phone.

In FIG. 2, an arrangement for testing the hearing device 1 is shown, wherein a mobile phone is depicted as accessory device 4. As can be seen, the hearing device 1 is placed on a display unit 9 of a mobile phone 4 which lies on an otherwise empty table such that the receiver unit 3 points towards the microphone 5 of the mobile phone 4 and the microphone unit 2 towards the loudspeaker 6 of the mobile phone 4.

A picture on the display unit 9 may show the exact position, where and how the hearing device 1 has to get placed. A defined acoustic path between the microphone unit 2 and the loudspeaker 6 as wells between the microphone 5 and the receiver unit 3 can thus get repeatedly established.

In a further embodiment of the present invention, the hearing device user calls a service phone number of the manufacturer, a fitter or any other third party providing such a service—or connects via an "App" (i.e. a specific software application running on the mobile phone) via the Internet or other services with the third party provider—, before placing the hearing device 1 on the display unit 9 of the mobile phone 4. Upon an instruction received via the mobile phone 4, the hearing device user places the mobile phone 4 on a table and the hearing device 1 onto the display unit 9 as indicated on the display unit 9. A defined tone or sequence of tones or other suitable acoustic signals is then played through the mobile phone 4, i.e. the loudspeaker 6, and received at the microphone unit 2 of the hearing device 1. The hearing device 1 amplifies the sounds either in its normal operating mode or in a special self test mode, into which the hearing device 1 got either manually for example by pressing a button on the hearing device 1 by the hearing device user, or by pressing a button on a remote control 12 that is operationally connected to the hearing device 1 wirelessly or via a wire (see FIG. 1). The self test mode can also be automatically selected via an acoustic command as played through the loudspeaker 6 of the mobile phone 4.

In the normal operating mode, the hearing device 1 emits the amplified sounds through the receiver unit 3, i.e. the second sound signal 8. The second sound signal 8 is picked up by the microphone 5 of the mobile phone 4, therewith a feedback loop is created that may result in feedback whistling if a gain in this feedback loop is too high. The problem of feedback whistling is even higher in the described testing mode because there is a direct acoustic path between the receiver unit 3 and the microphone unit 2 of the hearing device 1. Appropriate sound level settings must therefore assure that only a reduced gain is applied in the hearing device 1 while it is in the testing mode.

The picked up second sound signal is, for example, sent to a provider of the service phone number and evaluated there. For example, it is compared against the sounds picked up in a reference/calibration measurement as performed, for example, in the fitter's office with a known intact hearing device of the same or similar built.

Figure 3:
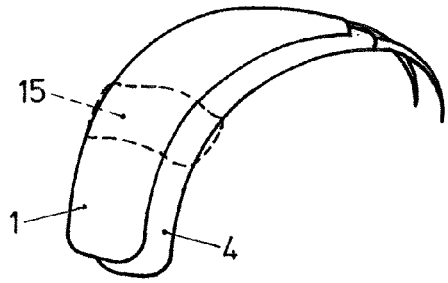
FIG. 3 shows an arrangement according to a further embodiment of the present invention, the arrangement comprising two hearing devices.

FIG. 3 shows an arrangement with two hearing devices, i.e. the accessory device 4 of FIG. 1 is now a second hearing device. The two hearing devices 1 and 4 may communicate with each other via a wire or via a wireless link, and are therefore able to test themselves.

Both hearing devices 1 and 4 are set into a self test mode, e.g. via a remote control unit (not shown in FIG. 3) and get placed in parallel adjacent to each other. For example, the hearing devices 1 and 4 are either set into a holder or get temporarily taped to each other, as it is indicated by a tape 15 in FIG. 3.

The first hearing device 1 then sends via his internal sound generator a suitable sound out of its receiver unit. Both hearing devices 1 and 4, as they lie together, receive at their microphones thus the same signal and evaluate it internally. They may exchange the results now or later on, for example via the wireless link. Afterwards, the second hearing device 4 sends a suitable sound out of its receiver unit to both hearing device microphones, where the sound gets evaluated again. By comparing the results from both measurements, one can determine the following:

If both results of the first measurement are within some tolerance equal, but lower/higher than the (also equal) results of the second measurement, the receiver/wax guard of the first/second hearing device 1/4 is either defect and/or has to get cleaned.

If the results of the first hearing device 1 is lower/higher than the results from the second hearing device 4, the microphone protection of the first/second hearing device 1/4 has to get replaced.

If the microphone unit of one of the hearing devices 1, 4 is fully broken, the results of the other hearing device 4, 1 for both measurements define if a receiver/wax guard must be replaced.

Broken receiver units are either nonfunctional at all, or generate high levels of distortion. A suitable distortion analysis of the measurement can indicate such a problem, as for example by a standard THD—(Total Harmonic Distortion)—analysis.

It is pointed out that both measurements can consist of multiple sub-measurements to distinguish frequency dependent attenuation effects from distortion, for example.

As both hearing devices 1 and 4 can exchange the results of the measurements with each other, they can come to a common conclusion and inform the user about the results, e.g. via an audio message, specific beeps, a graphical indication on the display of the remote control unit or nearby mobile phone, for example. Even when one hearing device 1, 4 is fully dysfunctional or even switched off, the other hearing device 4, 1 can determine this fact by not being able to communicate with the dysfunctional or switched-off hearing device 1, 4. Therefore, also in such a situation, the hearing device user can still be informed appropriately.

Figure 4:
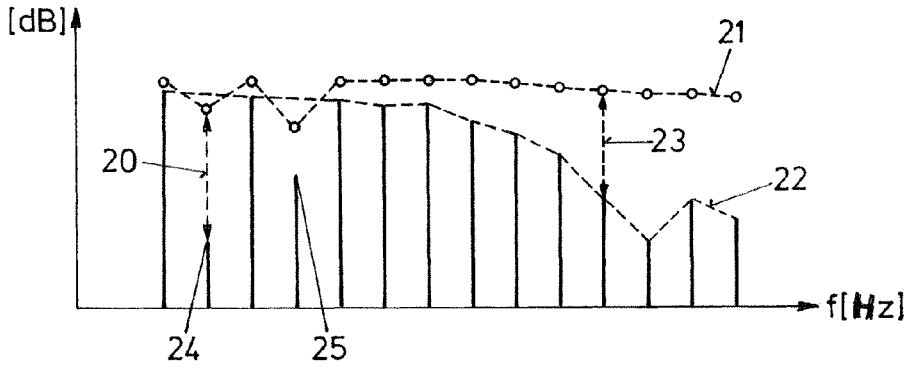
FIG. 4 shows a frequency spectrum of a second sound signal of a hearing device.

FIG. 4 shows a spectrum 22 of the second sound signal 8 (FIG. 1) of the hearing device 1, which is in a test mode setting. In addition, FIG. 4 also shows a standard spectrum 21 of a second sound signal from a known good hearing device. It can be clearly seen from the difference of the two spectra, for example at frequency bin 23, that an attenuation of sound is present due to dirt. Accordingly, the hearing device user is requested to take appropriate action in order to obtain good results with his hearing device again.

In a further embodiment of the present invention, in particular when the hearing device 1 is in such a test mode setting, the input level of the first sound signal 7 (FIG. 1) as measured within the signal processing unit 10 (FIG. 1) is transformed into another parameter which is used to control an internal sound generator. The sound generator may, for example, output a multi sine tone with equal amplitudes of the individual sinusoids except for one sinusoid, where the amplitude is determined by the measured input level. This is illustrated by a frequency bin 24 having a level according to a measured input level of the first sound signal 7 picked-up by the microphone unit 2—and not according to a level of the second sound signal 8 at the corresponding frequency. An attenuation 20 reflects an attenuation of the first sound signal 7 picked-up by the microphone unit 2 due to dirt, for example.

With such a setup, the service provider can determine and distinguish from the received multi sine signal not only if the microphone unit protection is dirty or the microphone unit 2 is defect, but also if the receiver unit 3 is defect, or wax guards are dirty or even blocked, respectively. Other data as gained from further internal tests performed by software running in the signal processing unit 10 may get used as well to control the magnitude of other sinusoids. For example, a frequency bin referenced by 25 may have a level representative to a result of other internal tests.

As attenuation due to dirt has generally a lowpass characteristic, one can evaluate the levels of bins 24 and/or 25 by comparing them with the levels of their neighboring bins even without having a calibration data available when bins 24 and 25 are within the lower frequencies being transmitted, albeit with some reduced accuracy.

As the sound emitted and recorded by the accessory device 4 (FIG. 1), i.e. due to changing loudspeaker 6 and microphone 5, may also change its frequency response or in general its properties over time as well, testing the microphone unit 2 and the receiver unit 3 with the accessory device 4 may lead to wrong results. Thus the output of the hearing device 1 as sent to the provider may have to get evaluated also over a span of time respectively multiple times to derive all necessary information.

If the test is finished, the user may get informed through an acoustic message by the service provider about the result of the test, and if some maintenance measures are required, suggested to make an appointment with his fitter. The result can of course get replayed as many times as wished for by pressing the right button on the keyboard of the mobile phone or the accessory device, for example. The phone call may then get ended.

In a further aspect of the present invention, the picture on the mobile phones display is transmitted as an MMS—(Multimedia Message Services) or generated by an application on the mobile phone. The MMS may have been sent before the call is initiated to the service provider, e.g. at the calibration at the fitter's office, or at the beginning of the phone call.

In a further aspect, the phone call to a service provider and evaluation of sound signals is at least to some part replaced by a software application on the mobile phone or accessory device. The result of the self test may then still get transmitted wirelessly to a remote server for collection and further analysis.

In a further aspect of the present invention, the service provider may inform the fitter directly, if the result indicates a significant maintenance effort or even a suggested or required visit in the fitter's office. The fitter may then either call the user of the hearing device to prepare the visit and/or order replacement parts as required such that only a single visit at the fitter's office is necessary.

It is further pointed out that the present invention is not only directed to hearing devices that are used to improve the hearing of hearing impaired patients. The present invention can very well be used in connection with any communication device, be it wired or wireless, or in connection with any hearing protection device.

What is claimed is:

1. A method for testing a hearing device comprising at least one microphone unit and a receiver unit, the method comprising steps of:

indicating a predefined position for positioning the hearing device on a display unit comprised in an accessory device, positioning the hearing device at the predefined position in relation to the accessory device comprising a microphone and a loudspeaker, generating a first sound signal by the loudspeaker, recording the first sound signal by the at least one microphone unit, generating a second sound signal by the receiver unit, the second sound signal being at least partly dependent on the recorded first sound signal, recording the second sound signal by the microphone, evaluating the recorded second sound signal, and at least triggering further action based on results of evaluating the recorded second sound signal in case the results do not conform to predefined expectation.

2. The method of claim 1, wherein the accessory device is one of the following devices:

a mobile phone;

a personal digital assistant device;

a second hearing device.

3. The method of claim 1, further comprising the step of initiating the testing of the hearing device by at least one of the following manners:

activating a switch unit at the hearing device;

activating a remote control unit that is operatively connected to the hearing device;

activating the accessory device.

4. The method of claim 1, further comprising the step of limiting a maximum gain of the hearing device applied to the first sound signal in order to prevent feedback.

5. The method of claim 1, wherein the second sound signal comprises information that is not correlated to the first sound signal.

6. The method of claim 5, wherein the information not correlated to the first sound signal is predefined and is used to evaluate an acoustic path between the receiver unit and the at least one microphone unit.

7. The method of claim 1, further comprising the step of setting up a connection to a remote provider unit, the remote provider unit or an application running on the accessory device being able to guide through a testing sequence.

8. An arrangement for testing a hearing device, the arrangement comprising:

an accessory device comprising a microphone and a loudspeaker for generating a first sound signal, and a display unit for indicating a predefined position for a hearing device, the hearing device comprising a microphone unit and a receiver unit for generating a second sound signal, wherein the loudspeaker is acoustically coupled to the microphone unit, and the receiver unit is acoustically coupled to the microphone, means for evaluating the second sound signal recorded by the microphone, and means for at least triggering further action based on results of evaluating the second sound signal recorded by the microphone in case the results do not conform to predefined expectation.

9. The arrangement of claim 8, wherein the accessory device is one of the following devices:

a mobile phone;

a personal digital assistant device;

a second hearing device.

10. The arrangement of claim 8, further comprising means for activating a testing sequence, said means on at least one of the following components:

the hearing device;

a remote control unit that is operatively connected to the hearing device;

the accessory device.

11. The arrangement of claim 8, wherein the second sound signal comprises information that is not correlated to the first sound signal.

12. The arrangement of claim 11, wherein the information not correlated to the first sound signal is predefined and is used to evaluate an acoustic path between the receiver unit and the microphone unit.

13. The arrangement of claim 8, further comprising a remote provider unit that is operatively connectable to the accessory device, the hearing device, or both.

* * * * *